US009387385B2

(12) United States Patent
Strano

(10) Patent No.: US 9,387,385 B2
(45) Date of Patent: Jul. 12, 2016

(54) CONSTRUCTION OF THE NOVEL GOLF TRAINING DEVICE

(71) Applicant: Robert Vincent Strano, Niceville, FL (US)

(72) Inventor: Robert Vincent Strano, Niceville, FL (US)

( * ) Notice: Subject to any disclaimer, the term of this patent is extended or adjusted under 35 U.S.C. 154(b) by 149 days.

(21) Appl. No.: 14/330,190

(22) Filed: Jul. 14, 2014

(65) Prior Publication Data

US 2016/0008691 A1 Jan. 14, 2016

(51) Int. Cl.
*A63B 69/36* (2006.01)

(52) U.S. Cl.
CPC ..... *A63B 69/3632* (2013.01); *A63B 2225/093* (2013.01)

(58) Field of Classification Search
CPC ..... A63B 69/36; A63B 69/3608; A63B 69/3632; A63B 69/3667; A63B 69/3676; A63B 69/3685; A63B 2225/093; F16M 13/02; F16M 13/00; F16B 2/02; F16B 2/06; F16B 2/10; F16B 2/04
USPC ..... 473/215, 216, 226, 227, 257, 266, 473/275–277; 248/230.4, 230.5, 230.6, 248/231.52, 231.61, 231.71, 316.5, 316.6
See application file for complete search history.

(56) References Cited

U.S. PATENT DOCUMENTS

| | | | | | |
|---|---|---|---|---|---|
| 100,571 | A * | 3/1870 | Watson | A47J 36/34 | 126/333 |
| 3,162,409 | A * | 12/1964 | Straayer | E04H 12/32 | 116/173 |
| 3,310,270 | A * | 3/1967 | Ciancio | F16L 3/08 | 248/210 |
| 3,385,545 | A * | 5/1968 | Patton | F16L 3/222 | 248/228.5 |
| 3,883,144 | A * | 5/1975 | Lazow | A63B 57/10 | 473/218 |
| 3,902,931 | A * | 9/1975 | Danciger | A47F 5/06 | 174/163 F |
| 4,190,224 | A * | 2/1980 | LeBlanc | A61G 5/10 | 248/227.3 |
| 4,270,721 | A * | 6/1981 | Mainor, Jr. | F16M 13/02 | 248/228.6 |
| 4,544,159 | A * | 10/1985 | Sells | A63B 69/36 | 473/218 |
| 4,711,422 | A * | 12/1987 | Ibanez | A47B 11/00 | 248/230.5 |
| 6,491,591 | B1 * | 12/2002 | Schuster | A63B 69/0059 | 473/206 |
| 7,160,199 | B1 * | 1/2007 | Mitchell | A63B 69/0057 | 473/219 |
| 7,258,622 | B1 * | 8/2007 | Gaviria | A63B 69/3632 | 473/219 |
| 7,658,683 | B1 * | 2/2010 | Daniel | A63B 53/007 | 473/294 |
| 8,790,188 | B2 * | 7/2014 | Hatton | A63B 69/0057 | 473/212 |
| 2001/0021674 | A1 * | 9/2001 | Takase | A63B 69/0059 | 473/212 |
| 2006/0122000 | A1 * | 6/2006 | Paredes | A63B 69/3638 | 473/219 |
| 2012/0118126 | A1 * | 5/2012 | Sato | G10D 13/026 | 84/421 |

* cited by examiner

*Primary Examiner* — Sebastiano Passaniti
(74) *Attorney, Agent, or Firm* — Inventions International Inc.; Tiffany C. Miller

(57) ABSTRACT

A golf training device having an alignment structure with a body configured to connect to an end of a shaft. The alignment structure has an alignment structure primary end located opposite an alignment structure secondary end. The alignment structure primary end has three protrusions radiating from the body of the alignment structure. The alignment structure secondary end has a single protrusion radiation from the body of the alignment structure. At least one protrusion is adapted to contact a portion of a user's torso. The body has an opening configured to connect to an end of a shaft. The shaft is configured to connect to a structure having a primary end being a golf club attaching end located opposite a secondary end of the structure being a shaft attaching end. The primary end of the structure has a hingedly connected jaw configured to grip the shaft of a golf club.

12 Claims, 5 Drawing Sheets

CONSTRUCTION OF THE NOVEL GOLF TRAINING DEVICE

BACKGROUND OF THE INVENTION

1. Field of the Invention

The novel invention relates, generally, to a golf training device. More particularly, it relates to a golf stroke strengthening and stability device.

2. Background Art

Prior art golf training devices such as the T-Bar are adapted to connect to the shaft of a golf club. The T-Bar is connected to the golf club shaft at a height great enough for the cross bar to contact a user's upper chest, right shoulder, and left shoulder. This crossbar is adapted to set a user's shoulder line parallel to a user's golf stroke line. There is a need for a golf training device that promotes more advanced levels of stability and strength training while eliminating the need for the prior art golf training device being in contact with a user's shoulders.

Prior art golf training devices are not constructed of a weighted material and may not contain weights for the purpose of strength training to enhance the golf stroke performance of a user. It is more desirable for a user to have the ability to strength train their muscles that are being utilized when performing a golf stroke. For instance, when a user performs a golf stroke using the novel golf training device, the result of a weighted golf stroke movement in combination with the user's torso being aligned with an alignment structure is that a user has a stronger and a more accurate golf stroke. Thus, there is a need for a golf training device that allows for the strengthening of a user's golf stroke performance with a weighted golf training device to achieve this kinesthetic after effect.

A particular failure of some prior art golf training devices is the use of a laser attachment adapted to be connected to the shaft of a golf club. The use of this prior art laser as a guide in an outdoor setting, particularly on a sunny day can be difficult to visually see, rendering the laser device inoperable. This can be unreliable especially since the majority of greens are outdoors. Thus, there is a need for a more reliable golf training device that can be visually operable in an outdoor setting.

There are several challenges to overcome with stabilizing a user's golf stroke. One challenge being the need to control the dynamics of the X, Y, and Z axes of the golf club face. The problem with controlling the X, Y, and Z axes of the golf club face is determining how to configure the golf training device to the golf club and how to configuring the golf training device in relation to a user's body so that the user's golf stroke is stable in both the backswing and the follow through.

However, in view of the prior art considered as a whole at the time the present invention was made; it was not obvious to those of ordinary skill in the pertinent art how the identified needs could be fulfilled.

SUMMARY OF THE INVENTION

The long-standing but heretofore unfulfilled need for a novel golf training device having a body configured to connect to an end of a shaft. The alignment structure has an alignment structure primary end located opposite an alignment structure secondary end. The alignment structure primary end has three protrusions radiating from the body of the alignment structure. The alignment structure secondary end has a single protrusion radiation from the body of the alignment structure. At least one protrusion is adapted to contact a portion of a user's torso. A user's torso includes, but is not limited to, the area located between a user's neck down to a user's waist. The body of the alignment structure has an opening configured to connect to an end of a shaft. The shaft is configured to connect to a structure having a primary end being a golf club attaching end located opposite a secondary end being a shaft attaching end and which also includes improvements that overcome the limitations of prior art golf club training devices is now met by a new, useful, and non-obvious invention.

The novel golf training device is adapted to be connected to the shaft of an existing golf club. It is within the scope of this invention for the novel golf training device to be connected to the upper 50 percent portion of the shaft of a golf club. It is a preferred embodiment for the novel golf training device to be connected to a golf club grip. An integrated clamping bracket structure has a primary end having a recess that is configured to connect to the shaft of a golf club and has a secondary end configured to connect to an alignment structure shaft.

The primary end of the integrated clamping bracket structure has a hingedly connected jaw configured to grip the shaft of a golf club. A threaded knob is configured to screw onto a swing bolt. When the knob is tightened by a user, the knob tightens against a surface of the jaw causing the jaw to grip the shaft of a golf club.

The secondary end of the integrated clamping bracket structure has a friction element, a J-bolt, and a threaded knob. An opening is located through both a portion of a planar surface of the secondary end of the bracket and through a friction element. This opening is configured to receive a fastener including, but not limited to, a J-bolt. A threaded knob is configured to screw onto a J-bolt. When the threaded knob is tightened by a user, the threaded knob tightens against a surface of the bracket causing the J-bolt to draw in and capture the alignment structure shaft, thereby, binding the alignment structure shaft to the bracket.

A surface of the integrated clamping bracket structure has a mounting structure connected to a surface thereon. The mounting structure has an opening. A jaw having a recess and having an opening has an end portion that is connected to the mounting structure. The mounting structure and the jaw both have an opening adapted to receive a fastener including, but not limited to, a split roll pin, a cotter pin, a screw, a roll pin, or a pin. The primary end of the bracket has at least one opening adapted to receive a fastener including, but not limited to, a swing bolt.

The integrated clamping bracket structure has a secondary end having a portion of the secondary end having a substantially planar surface capable of receiving a friction element being any deformable material including, but not limited to, cork, rubber, silicone rubber, or a combination thereof that will bind the alignment structure shaft to the bracket. It is within the scope of this invention for the friction element to be made of a material having a high coefficient of friction, a high rating of UV protection, and having a durometer range between 60 and 80. The friction element is connected to the surface of the secondary end with an attaching element including, but not limited to, an adhesive. Although not a preferred embodiment, it is also within the scope of this invention to connect the alignment structure shaft to the secondary end of the clamping bracket structure without a friction element.

In a preferred embodiment, the alignment structure shaft has an end that is adapted to be inserted through the alignment structure opening of the alignment structure body. The alignment structure is secured to the end of the alignment structure shaft when an end of the alignment structure shaft is inserted through the opening of the alignment structure body. The alignment structure has at least one protrusion adapted to contact with a user's torso. In a preferred embodiment, the alignment structure has a primary end having three protrusions radiating from the alignment structure. These three protrusions are adapted to each contact a portion of a user's torso.

The alignment structure has a secondary end located opposite of the primary end of the alignment structure. The secondary end has a single protruding structure radiating from the alignment structure that is adapted to come into contact with a user's torso. The single protruding structure results in a more advanced training method than the three protrusion embodiment.

It is within the scope of this invention for the alignment structure to be configured to weigh between 1 ounce and 24 ounces. The alignment structure can have a plurality of differing weights that correspond to a plurality of differing levels of strength training for a user. For instance, a user that wants to strength train at a beginner level can attach an alignment structure to the alignment structure shaft that is configured to weigh approximately 1 ounce. A user at an intermediate level can attach an alignment structure to the alignment structure shaft end configured to weigh approximately 6 ounces. A user wanting to strength train at a more advanced level can add a heavier alignment structure to the alignment structure shaft end configured to weigh approximately 10 ounces.

In another embodiment, the novel golf training device can be constructed of a weighted material including, but not limited to, aluminum, brass, or steel. This heavier weight of the novel golf training device allows for the user to strength train while the novel golf training device is attached to the golf club. After the novel golf training device has been practiced with by a user and the golf training device has been removed from the user's golf club, the result is strength training of muscles used specifically in the learned stroke. Practice by a user with this heavier golf club with the novel golf training device attached thereto results in the enhancement of a user's golf stroke performance by building muscle strength of the muscles that specifically perform the learned golf stroke.

In another embodiment, the novel golf training device is adapted to receive at least one removable weight attachment. The weight attachment can attach to the golf training device with an attaching element including, but not limited to, a clamp or a magnet. In a preferred embodiment, the novel golf training device includes a plurality of weights that are adapted to attach to a golf club. The amount of weight used during a practice session with the novel golf training device can be tailored to a user's skill level. For instance, a beginner can connect approximately 5 ounces of weight to the novel golf training device. A more advanced user can connect approximately 10 ounces of weight to the novel golf training device. It is within the scope of this invention for the novel golf training device to be constructed of a magnetically conductive material, whereby, a user can attach a plurality of differing weights of magnets to the golf training device without the use of an attaching element.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
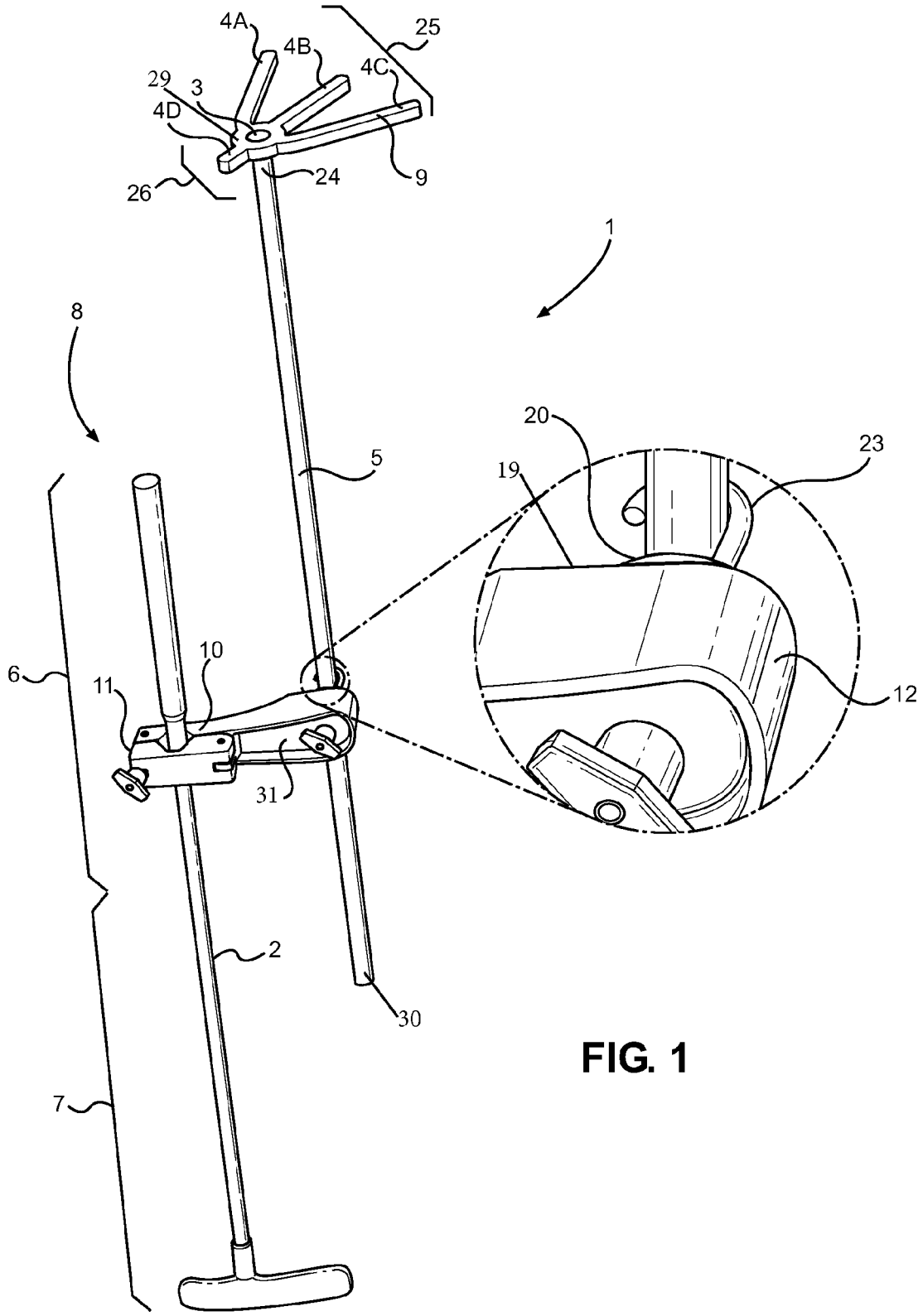
FIG. 1 is a perspective view of the novel golf training device connected to a golf club.

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

In a general embodiment the novel golf training device 1 has stabilizing structure 9 having body 29. Body 29 is configured to connect to end 24 of shaft 5. Shaft 5 has primary shaft end 24 located opposite secondary shaft end 30. Primary end 25 of stabilizing structure 9 is located opposite secondary end 26 of stabilizing structure 9. Primary end 25 of stabilizing structure 9 has protrusions 4A, 4B, and 4C. Secondary end 26 of stabilizing structure 9 has single protrusion 4D. At least one protrusion is configured to contact a user's torso (not shown). This contact establishes a vertical hinge point resulting in a balanced alignment of a user's backswing (not shown) and a user's follow through (not shown).

In another embodiment, body 29 has opening 3 configured to be received by end 24 of shaft 5.

In another embodiment, stabilizing structure 9 is configured to weigh between 1 ounce and 24 ounces.

Another embodiment of novel golf training device 1 includes shaft 5 configured to connect to structure 10. Structure 10 has primary end 11 being golf club 8 attaching end located opposite secondary end 12 of structure 10 being shaft 5 attaching end. Secondary end 12 of structure 10 has wall 19. Wall 19 has opening 22 configured to receive fastener 23. Fastener 23 has an end configured to retain shaft 5. Shaft 5 is configured to be captured and secured to wall 19 of structure 10 by fastener 23. Primary end 11 of structure 10 has recess 15. Recess 15 is configured to connect to shaft 2 of golf club 8. Structure 10 has tab 14 configured to be hinge point 13B located on a surface of structure 10. Jaw 16 is hingedly connected to tab 14. Jaw has recess 15, whereby, jaw 15 is configured to capture and grip shaft 2 of golf club 8 to primary end 11 of structure 10 when a force is applied to fastener 17 associated with jaw 16.

It is a preferred embodiment that golf training device 1 includes at least one recess 31 configured to remove weight from structure 10. It is within the scope of this invention for structure 10 to be constructed of a plurality of recesses 31 and 32 to remove weight from structure 10. In an alternate embodiment, structure 10 can be constructed of single recess 31 and not recess 32. It is within the scope of this invention for structure 10 to not have a recess configured to remove weight from structure 10, whereby, structure 10 could be made of a light weight material allowing for structure 10 to not need a recess to remove weight from structure 10.

Novel golf training device 1 includes fastener 23 being a J-bolt. Fastener 23 is adapted to receive threaded knob 18B, whereby, threaded knob 18B is configured to be tightened or loosened by a user (not shown).

In another embodiment, wall 19 is associated with friction element 20. Friction element 20 has opening 22 configured to receive fastener 23.

In another embodiment, jaw 16 has slot 27 located opposite hinge point 13B. Slot 27 is configured to receive swinging fastener 17. Swinging fastener 17 is pivotally connected to primary end 11 of structure 10. Swinging fastener 17 is adapted to receive threaded knob 18A, whereby, threaded knob 18A is configured to be tightened or loosened by a user.

In another embodiment, structure 10 is adapted to receive at least one weight of at least one ounce.

CONSTRUCTION OF THE NOVEL DEFORMABLE POCKET

Figure 2:
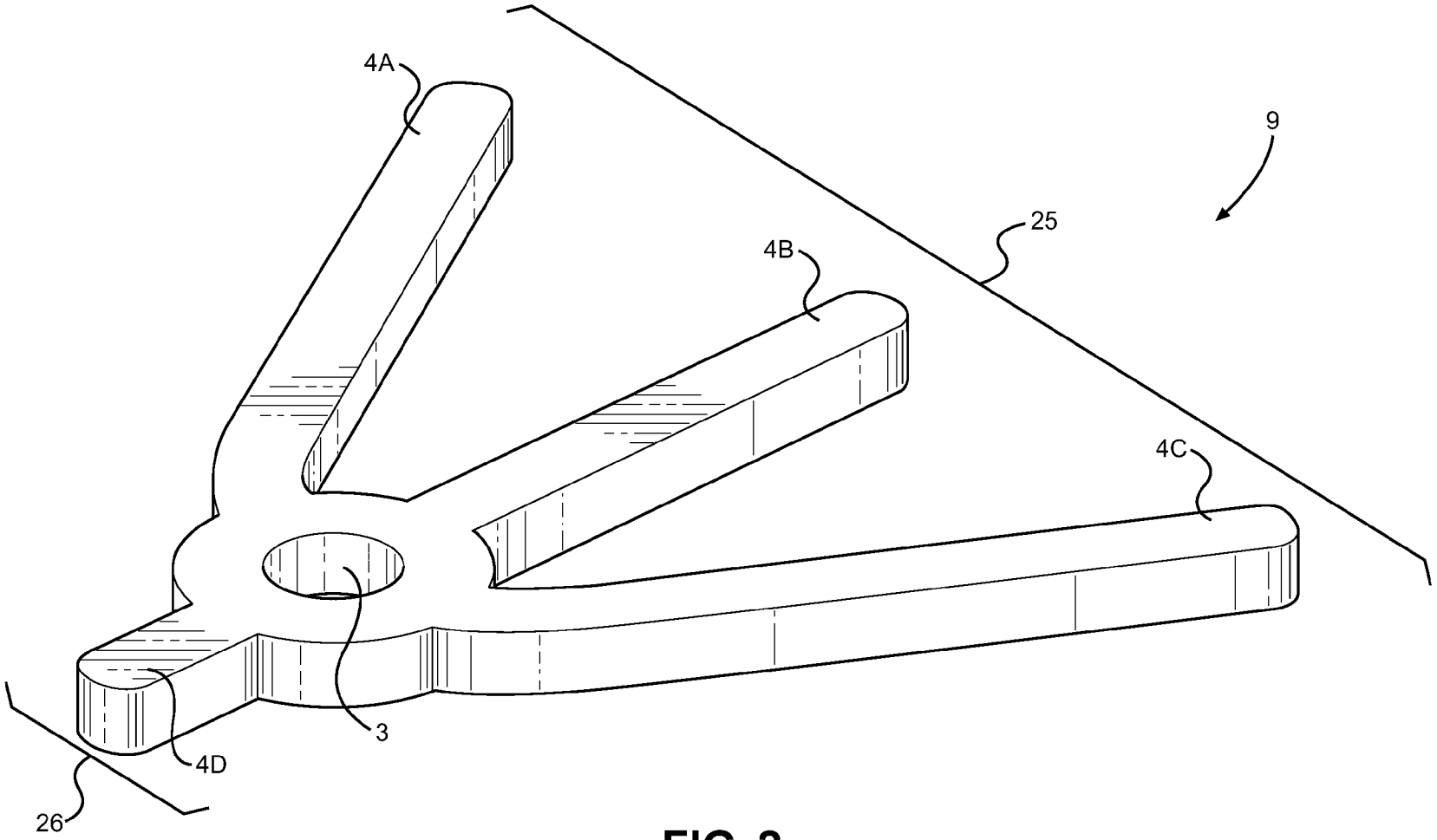
FIG. 2 is a perspective view of the novel alignment structure.
Figure 3:
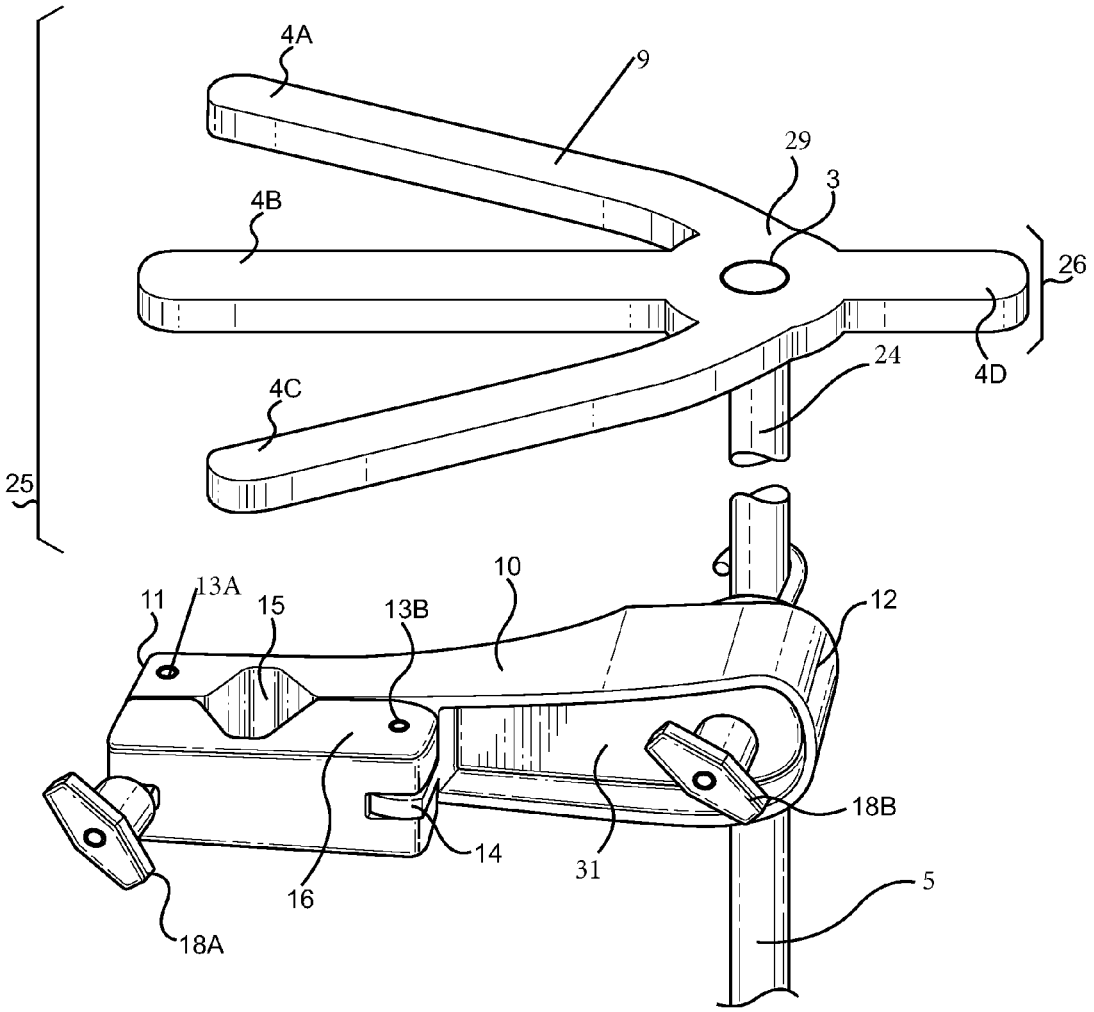
FIG. 3 is a perspective view of the novel alignment structure attached to a shaft connected to the integrated clamping bracket structure.

It will now be seen, referring to FIG. 1, novel golf teaching device 1 is connected to shaft 2 of golf club 8. Shaft 2 of golf club 8 has upper 50 percent portion 6 and lower 50 percent portion 7. It is a preferred embodiment for golf teaching device 1 to be connected to upper 50 percent portion 6 of shaft 2. Integrated clamping bracket structure 10 has primary end 11 that is configured to attach to shaft 2 of golf club 8. Integrated clamping bracket structure 10 has secondary end 12. J-bolt 23 captures and secures alignment structure shaft 5 against bracket 10. Shaft 5 has first shaft end 24 located opposite second shaft end 30. Friction element 20 is located on planar surface 19 of bracket 10. FIGS. 1 and 3 show alignment structure shaft 5 having end 24 configured to receive opening 3 of stabilizing structure 9. FIGS. 1 and 3 also depict body 29 configured to connect to end 24 of shaft 5. FIGS. 1, 2, and 3 depict alignment structure 9 having primary end 25 located opposite secondary end 26. Primary end 25 has a plurality of protrusions 4A, 4B, and 4C. Secondary end 26 has a single protrusion 4D. FIGS. 1, 3, 4, and 6 show structure 10 having recess 31. Recess 31 is adapted to remove weight from structure 10.

Figure 4:
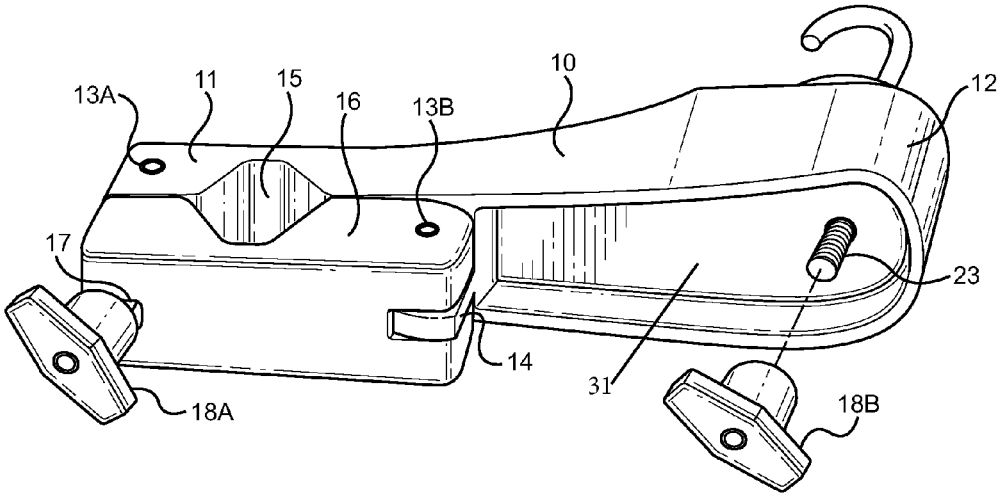
FIG. 4 is a perspective view of the novel integrated clamping bracket structure having a J-bolt and a swing bolt.
Figure 5:
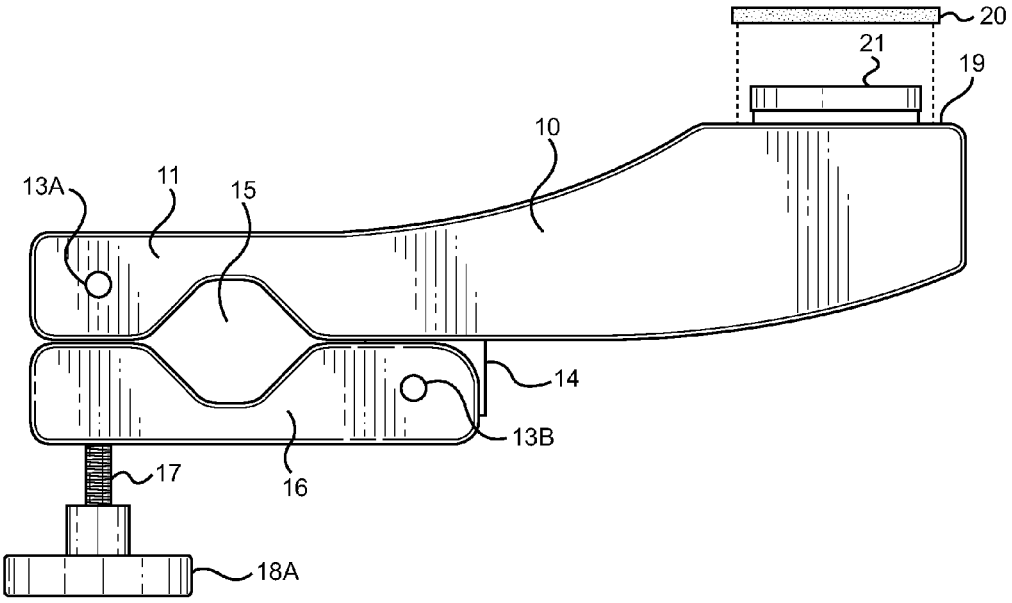
FIG. 5 is a top view of the novel integrated clamping bracket structure having a friction element and an attaching element.

FIGS. 3, 4, and 5 illustrate integrated clamping bracket structure 10 having primary end 11 with recess 15 located opposite secondary end 12. Jaw 16 has recess 15 and is hingedly connected to mounting structure 14. Threaded knob 18A is adapted to come in contact with a portion of jaw 16 when a user (not shown) tightens threaded knob 18A along swing bolt 17 (FIGS. 4 and 5). Threaded knob 18B is adapted to come in contact with a portion of bracket 10 when a user (not shown) tightens threaded knob 18B along J-bolt 23 (FIG. 4). Pivot point 13A and hinge point 13B are configured to receive a split roll pin (not shown).

FIG. 5 shows integrated clamping bracket structure 10 having planar surface 19. Planar surface 19 is adapted to receive friction element 20 connected with attaching element 21.

Figure 6:
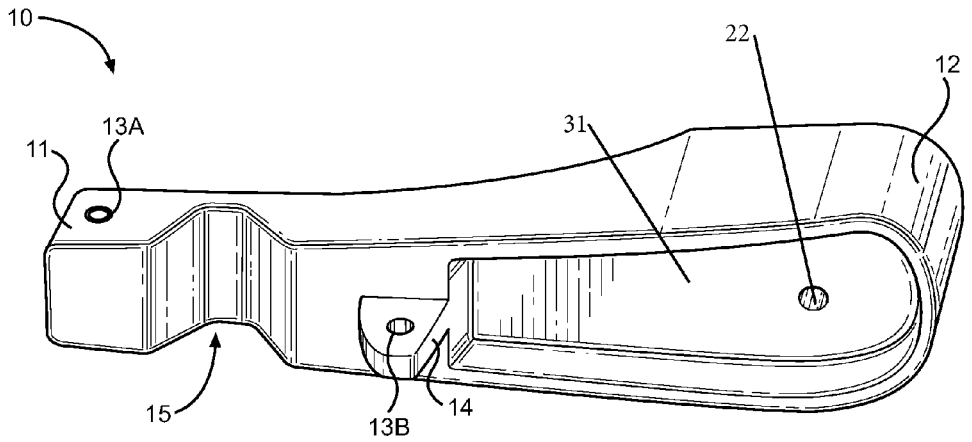
FIG. 6 is a partial view of the novel integrated clamping bracket structure having a mounting structure; and, FIG. 7 is a side view of novel integrated clamping bracket structure.

FIG. 6 depicts integrated clamping bracket structure 10 having primary end 11 with recess 15 located opposite secondary end 12 having mounting structure 14. Pivot point 13A and hinge point 13B are configured to receive a split roll pin (not shown). Opening 22 is adapted to receive a J-bolt.

Figure 7:
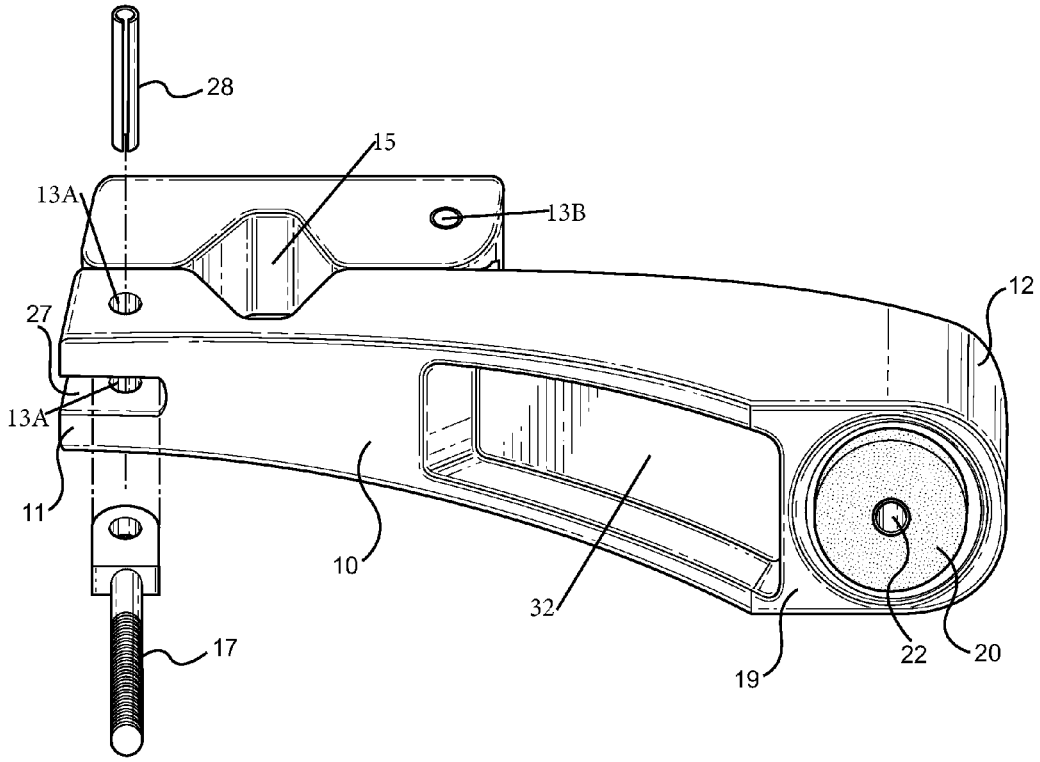

FIG. 7 shows integrated clamping bracket structure 10 having primary end 11 having slot 27. Swing bolt 17 is configured to be received by slot 27 and secured by split roll pin 28. Split roll pin 28 is received by openings 13A. Secondary end 12 of bracket 10 has planar surface 19. Friction element 20 is attached to planar surface 19 with an attaching element (not shown). Opening 22 is adapted to receive a J-bolt (not shown). Recess 32 is configured to remove weight from structure 10.

These and other important objects, advantages, and features of the invention will become clear as this description proceeds.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A golf training device in combination with a golf club having a handle, a golf club shaft and a golf club head; said golf training device, comprising:

a stabilizing structure comprising: a shaft and a body;

said shaft of said stabilizing structure having a first shaft end located opposite a second shaft end;

said body is connected to said shaft of said stabilizing structure;

said body of said stabilizing structure comprising:

a first end and a second end, said first end of said body is located opposite said second end of said body, said first end of said body having at least two protrusions extending from said body, said second end of said body having at least one protrusion extending from said body, whereby, said at least one protrusion is configured to contact a user's torso when said stabilizing structure is attached to said golf club;

said shaft of said stabilizing structure is configured to connect to a structure;

a structure having a first end of said structure being a golf club attaching end located opposite a second end of said structure being an attaching end for said shaft of said stabilizing structure, whereby, said second end of said structure having a wall, said wall having an opening, whereby, said opening is configured to receive a fastener; and, a fastener having an end configured to retain said shaft of said stabilizing structure, said shaft of said stabilizing structure is configured to be captured and secured to said wall of said structure by said fastener, said first end of said structure having a recess, whereby, said recess is configured to connect to said shaft of said golf club, said structure having a tab configured to be a hinge point located on a surface of said structure, whereby, a jaw is hingedly connected to said tab, said jaw having a recess, whereby, said jaw is configured to capture and grip said shaft of said golf club to said first end of said structure when a force is applied to a fastener associated with said jaw.

2. The golf training device of claim 1, wherein said fastener is a J-bolt.

3. The golf training device of claim 2, wherein said fastener is adapted to receive a threaded knob, whereby, said threaded knob is configured to be tightened or loosened by a user.

4. The golf training device of claim 1, wherein said wall is associated with a friction element.

5. The golf training device of claim 4, wherein said friction element has an opening, said opening is configured to receive said fastener.

6. The golf training device of claim 1, wherein said jaw has a slot located opposite said hinge point, said slot is configured to receive a swinging fastener.

7. The golf training device of claim 6, wherein said swinging fastener is pivotally connected to said first end of said structure.

8. The golf training device of claim 6, wherein said swinging fastener is adapted to receive a threaded knob, whereby, said threaded knob is configured to be tightened or loosened by a user.

9. The golf training device of claim 1, wherein said structure is adapted to receive at least one weight of at least one ounce.

10. The golf training device of claim 1, wherein said body of said stabilizing structure having an opening, whereby, said opening is configured to be received by an end of said shaft of said stabilizing structure.

11. The golf training device of claim 1, wherein said body of said stabilizing structure is configured to weigh between 1 ounce and 24 ounces.

12. The golf training device of claim 1, wherein said structure having at least one recess configured to remove weight from said structure.

* * * * *